US010933420B2

(12) United States Patent
Jordan Navas et al.

(10) Patent No.: US 10,933,420 B2
(45) Date of Patent: Mar. 2, 2021

(54) SAMPLE SLIDE STORAGE TRAY, CABINET FOR ITS STORAGE AND DEVICE FOR IDENTIFYING THE SLIDES

(71) Applicant: DREAMPATH DIAGNOSTICS, Strasbourg (FR)

(72) Inventors: Pablo Jordan Navas, Bristol (GB); Valerie Wilhelm, Eschau (FR); Arnaud Cremel, Eschau (FR)

(73) Assignee: DREAMPATH DIAGNOSTICS, Strasbourg (FR)

( * ) Notice: Subject to any disclaimer, the term of this patent is extended or adjusted under 35 U.S.C. 154(b) by 323 days.

(21) Appl. No.: 15/893,606

(22) Filed: Feb. 10, 2018

(65) Prior Publication Data

US 2018/0257080 A1 Sep. 13, 2018

(30) Foreign Application Priority Data

Mar. 7, 2017 (FR) ..... 17 51817
Jun. 13, 2017 (FR) ..... 17 55307
Jan. 30, 2018 (EP) ..... 18154251

(51) Int. Cl.
*B01L 9/00* (2006.01)

(52) U.S. Cl.
CPC ..... *B01L 9/52* (2013.01); *B01L 2300/021* (2013.01); *B01L 2300/0822* (2013.01); *B01L 2300/0858* (2013.01); *B01L 2300/123* (2013.01)

(58) Field of Classification Search
USPC ..... 422/551, 552, 556
See application file for complete search history.

(56) References Cited

U.S. PATENT DOCUMENTS

2002/0183882 A1 12/2002 Dearing
2005/0270642 A1* 12/2005 McLellan ..... G02B 21/34 359/391
2013/0123979 A1* 5/2013 Elliot ..... G02B 21/34 700/245
2015/0205089 A1* 7/2015 Machida ..... B01L 9/52 359/391

FOREIGN PATENT DOCUMENTS

EP 1 380 345 A2 1/2004
EP 2 883 813 A1 6/2015
WO 2006098441 A1 9/2006
WO 2010004331 A1 1/2010

* cited by examiner

*Primary Examiner* — Dean Kwak
(74) *Attorney, Agent, or Firm* — Craft Chu PLLC; Andrew W. Chu

(57) ABSTRACT

The tray for the storage of sample slides includes a plate with a plurality of cells. The plate has at least a bottom and two opposing side walls, having an entrance opening and being at least partly closed by a transverse wall. Each cell includes at least two protrusions protruding respectively at each of the side walls and forming adjacent sliding elements to guide the edges of a slide upon introduction into a cell. The bottom of each cell is inclined at an angle α relative to the plane of the tray, while the length of each slide is less than the length of the slide that is intended to be stored in a cell. The invention also relates to a cabinet for storing such a tray and a device for identifying the slides stored in such a tray.

7 Claims, 3 Drawing Sheets

SAMPLE SLIDE STORAGE TRAY, CABINET FOR ITS STORAGE AND DEVICE FOR IDENTIFYING THE SLIDES

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention is intended for the medical field in the analysis of tissue and cell samples.

The invention relates more particularly to the orderly conservation and storage of such samples.

2. Description of Related Art Including Information Disclosed Under 37 CFR 1.97 and 37 CFR 1.98

As part of the medical care of a patient or in the context of research, human, animal or plant tissue or cell samples may be taken and used for histological and/or molecular analysis. For purposes of observation and conservation, these samples are usually arranged in the center of a support in the form of a rectangular slide of transparent plastic material but more often transparent glass, in particular "white glass". Such slides have standardized dimensions, generally from 75 to 76 mm (millimeters) in length, 25 to 26 mm in width, and a thickness of about 1 mm. These dimensions are particularly suitable for use in microscopic analysis.

Processing may be applied to the sample thus disposed on such a slide, such as for example coloration, before being covered by a cover slide, generally of square, rectangular or round shape, or a transparent film. A protective adhesive material may also be added over all to bind the slide and cover slide, allowing conservation of the sample over time, while allowing examination under a microscope. Finally, sample and patient data are applied to one side of the slide for classification and subsequent identification. These data may be directly affixed to the part of the slide having an area provided for this purpose or added in the form of an adhesive label. The whole thus forms a sample slide.

The invention relates to the ordered storage of such sample slides, the conservation of the slides stored in an orderly manner, and the computer management of the storage of these sample slides.

To this end, the invention relates to a sample slide storage and arrangement tray, a cabinet designed to house at least one sample slide storage tray, as well as a specific device for identifying the sample slides contained in such a storage tray.

It should be noted that in the context of the present invention, unless otherwise stated, the terms "slides" and "sample slides" are equivalent.

Currently, once prepared, the sample slides are stored and manipulated manually by operators who have not necessarily received specific training and without supervision. As a result, this risky manual management leads to errors and a considerable loss of time, possibly leading to the detrimental misplacement of certain slides.

Specifically, in the case of storage, the sample slides are stacked in alpha-numeric order in stacks of up to several hundreds. The stacks are then placed in a storage unit, such as a box or a drawer. Once stored, it is difficult to find a particular slide within its stack, since its identifying information is hidden by other stacked slides, except possibly for the slide on top of each stack.

In a related manner, manipulations of the stacked slides often result in scraping that may damage the biological material deposited therein.

As it stands, there is a real problem related to the ordered storage of the sampled slides to ensure classification and management enabling a particular slide to be found quickly, simply, and safely later.

One solution to this problem as disclosed in document WO 2010/004331, consists in a device provided with drawers in which sample slides provided with identification means are positioned vertically. In other words, the drawer extends in a horizontal or substantially horizontal plane while the slides are arranged orthogonally with respect to such a horizontal plane.

More specifically, each drawer is compartmentalized and has a series of individual sleeves regularly spaced along its length, into which the slides may be slid from above, wherein the identification labels the slides carry are oriented upwards. In addition, each drawer is mounted to slide through an opening on a support frame equipped on top with a RFID type radio reader (for "Radio Frequency Identification") to read remotely the information recorded within chips contained in the adhesive labels affixed to each of the slides.

Thus, each time the drawer is closed, the information contained in the respective labels of the slides in the drawer is read by the reader, which makes it possible to identify each of the slides and to record their respective position within the drawer.

A major problem, related to the use of RFID technology, results in the transmission field of the reader, which, even when localized, transmits radio waves that are likely to communicate with the chips of several slides positioned adjacent to each other in the same drawer. In addition, the translation speed of the manually-operated drawer affects the reading quality of the reader. In addition, if a slot is empty, the reader is not able to detect the absence of the slide and may identify the following slide, which gives rise to uncertainty as to the positions of the slides within the drawer. Finally, in addition to the fact that the device that is the object of WO 2010/004331 does not always make it possible to automatically determine the exact position of a desired slide, the vertical arrangement of several adjacent slides with only a small space between them, does not allow an operator to find the desired slide visually, simply and quickly, because the label of the slide located at the front hides the label of the slide behind. It has also been found that the technology used, based on RFID chips with a limited service life, is not always adapted to ensure identification over time of sampled slides whose average storage time is several decades.

An alternative solution, consisting of positioning the slides horizontally in housings formed in a tray support, has also been proposed. The housings are in the form of cells forming recesses of rectangular parallelepiped shape and of dimensions generally at least partially complementary to those of the slides in order to allow insertion from above. The slides are therefore positioned flat in the open upper surface of such a tray and arranged next to each other in columns and rows in a plane parallel to the bottom of the tray and without overlapping. This arrangement makes it possible to easily read, manually or automatically, their respective identification data which thus face upwards and are not hidden by any adjacent slides.

However, such an arrangement of the slides on such a tray, requires increased storage space when compared with a stack or an arrangement where they extend side by side perpendicular to the bottom of a drawer. In fact, a flat arrangement of juxtaposed slides requires a storage area equivalent to the sum of the area of the slides. The number of slides that may be stored in this way on a single tray is therefore limited and corresponds to a maximum tray size beyond which it becomes too bulky and difficult to handle. Thus, in order to store a large number of slides with such a solution, it is necessary to distribute the slides over several trays of acceptable dimensions in terms of handling and space. However, it is then also necessary to identify each tray in order to find a desired slide.

In addition, an arrangement of the slides parallel to the bottom of such a tray where they are simply pushed flat in cells that are open at the top and although the cells have a shape and dimension adapted to those of the slides, leads to more than precarious holding of the slides. As such a tray i intended to be moved and manipulated, there is a significant risk that the slides will slip out of their cell in the event of inadvertent inclination of the tray, in particular if it turns or tips over due to inadvertence on the part of the person handling the tray.

One solution to this problem is to adapt the structure of the cells for receiving the slides, for example by completing them with protuberances or bosses, resulting in a forced insertion of each slide into the cell in question. However, it then becomes difficult to extract a slide from its cell, because of this excessive holding force, causing a loss of time and sometimes leading to deterioration, or even breakage of the slide during a somewhat forced extraction.

There is thus a real problem in holding the slides within their cell, as it must be affected in such a way that they cannot be dislodged inadvertently; but should allow easy and fast insertion and extraction without risk of damage to the slides.

BRIEF SUMMARY OF THE INVENTION

The present invention has the object of overcoming the disadvantages of the prior art by proposing a solution for the conservation and ordered storage of sample slides that offers an improvement over the solutions of the prior art. In particular, the invention has the object of proposing a solution for storing the slides in such a way that they may be identified and located in a definite manner, while recording all the corresponding data within a referencing system enabling them to be found quickly and simply when sought.

In addition, the invention has the object of proposing a storage solution with which the number of stored slides is optimized with respect to the space required, and which guarantees perfect viewing of the identification data of each of the slides, as well as the reading of all of them.

Furthermore, the invention also has the object of proposing a cabinet for storing one or more trays housing the slides, wherein the cabinet is specifically designed to both conserve the structural integrity of the trays throughout their storage and provide optimized tray storage capacity.

Another object of the invention is to provide a device for reading the identification data affixed to the sample slides and which is adapted to the specific shape of the tray according to the invention and is designed to read the data without error.

Thus, the main object of the invention is a tray for storing sample slides and consisting of a plate comprising a plurality of aligned cells that are hollowed out of the thickness of the tray, and are designed to fit the shape and dimensions of the slides at least partially, wherein each cell comprises at least a bottom and two opposing side walls and with an entrance opening and is at least partly closed by a transverse wall extending between the opposing walls facing the entrance opening, wherein each cell comprises at least two protrusions respectively protruding from each of the side walls, and wherein the protrusions extend from the entrance opening to the transverse wall parallel to the bottom and forming sliding elements with the adjacent offset cells that are designed to guide the edges of a slide when introduced into a cell, wherein such a tray is characterized by the bottom of each cell being inclined at an angle $\alpha$ relative to the plane of the tray, while the length of each sliding element is less than the length of a slide to be stored in a cell.

In fact, the invention thus provides a specific arrangement of the sample slides, i.e. not vertical nor horizontal with respect to the plane containing the tray but inclined thereto. Thus, the cells comprising the tray according to the invention are specifically shaped to receive the slides upon insertion in such a way that they are inclined relative to the plane in which the tray extends. This inclination allows partial superposition of the slides. In fact, the cells are advantageously dimensioned so that when the slides are housed, a portion of a first slide is covered by another adjacent slide, while another portion of the first slide comprising the identification data, is not covered. In sum, each slide protrudes from its cell and covers a portion of the slide inserted into the cell below but leaves the portion of this slide with the identification data uncovered. This partial overlap makes it possible to considerably reduce the surface of the tray for the same number of stored slides. On the other hand, the thickness of the tray is increased according to the angle of inclination of the bottom of the cells, but to a lesser extent, as a result of the minimal thickness of the slides with respect to their length.

The invention thus makes it possible to achieve storage of a larger number of slides in a smaller surface area, when compared with the area occupied by a known arrangement of slides juxtaposed flat.

In addition, this partial overlapping arrangement leaves the data affixed to each slide visible, while allowing, on the one hand, precise slide location and, on the other hand, easy and definite visual or automated recognition of each cell as well as each slide contained therein.

According to the invention, the angle of inclination α of the bottom of each cell lies between 5° and 45°, preferably between 8° and 25°.

To achieve the other objects of the invention mentioned above, it is further provided that the tray according to the invention is characterized by each cell comprising at least one elastic member that is movable between a released position when the cell is empty and a constrained position when a slide is housed in the cell.

Therefore, each slide inserted into a cell is locked in position by the elastic member which pushes the slide against the wall opposite to that from which it extends. In addition, the orientation of this elastic member provides sufficient force to block the slide in its cell, while allowing easy manual or automatic insertion and extraction.

According to a preferred embodiment, each elastic member may comprise at least one tongue protruding from the bottom of the cell.

It is further provided that the tongue may have an end secured to the bottom of the cell and an opposing free end.

In this case, the tongue extends from the bottom of the cell preferably in such a manner that its free end is oriented towards the transverse wall.

The tray according to the invention is further characterized by it consisting at least in part of plastic material imparting elastic characteristics to the elastic member.

An additional feature of the tray according to the invention is further characterized by the fact that at least two opposite edges of the tray each comprise means that form, as the case may be, a rail or a sliding element intended to interact with a sliding element or a rail of complementary shape in a cabinet shaped to house the tray.

The invention also relates to a cabinet shaped to house at least one tray according to the invention, wherein at least two opposing edges of the tray each comprise means that form, as the case may be, a rail or a sliding element, wherein the cabinet comprises a bottom surmounted by a peripheral wall having an entrance opening and an upper wall opposite the bottom, and characterized by comprising means that form, as the case may be, a rail or a sliding element extending in an appropriate manner on the inner surfaces of the bottom and the upper wall, or on the inner surfaces of two opposing walls of the peripheral wall.

Furthermore, the invention also relates to a device for the identification of the slides stored within a tray as previously defined, wherein the device comprises an envelope provided with an opening, wherein the envelope defines a cell designed to house the tray and encloses means designed to detect the presence of a slide within each cell of the tray and to identify each detected slide by reading identification data affixed to a front portion of each slide, characterized by the cavity extending relative to the envelope along a longitudinal axis Y inclined at an angle γ relative to a horizontal plane.

According to a preferred embodiment, the angle of inclination γ of the longitudinal axis Y lies between 5° and 90°, preferably between 5° and 45°, for example equal to 8°.

BRIEF DESCRIPTION OF THE SEVERAL VIEWS OF THE DRAWINGS

Other characteristics and advantages of the invention will become apparent from the detailed description which follows of a non-limiting embodiment of the invention, with reference to the appended figures.

DETAILED DESCRIPTION OF THE INVENTION

The present invention relates to the storage and arrangement of sample slides 1.

As mentioned above, the slides 1 have a rectangular parallelepiped shape. As a reminder, such slides have standardized dimensions of 75 to 76 mm in length, 25 to 26 mm in width, and a thickness e of about 1 mm.

The slides 1 are made of transparent material, in particular glass. They receive on a portion of a surface, in particular on the upper surface 2 having the biological sample, identification information which is applied, for example, on an adhesive label affixed thereto. The opposing lower surface 3 may also receive elements but is usually empty and completely smooth.

It should be noted that the identification information may be handwritten but is most often in the form of encoded data, in particular of the barcode or matrix code type. Such identification information makes it possible to uniquely identify each slide 1 in particular by assigning it a unique number and linking it to other data, in particular data relating to the patient whose sample is present on the slide 1, in a related computer system, such as a database.

Figure 1:
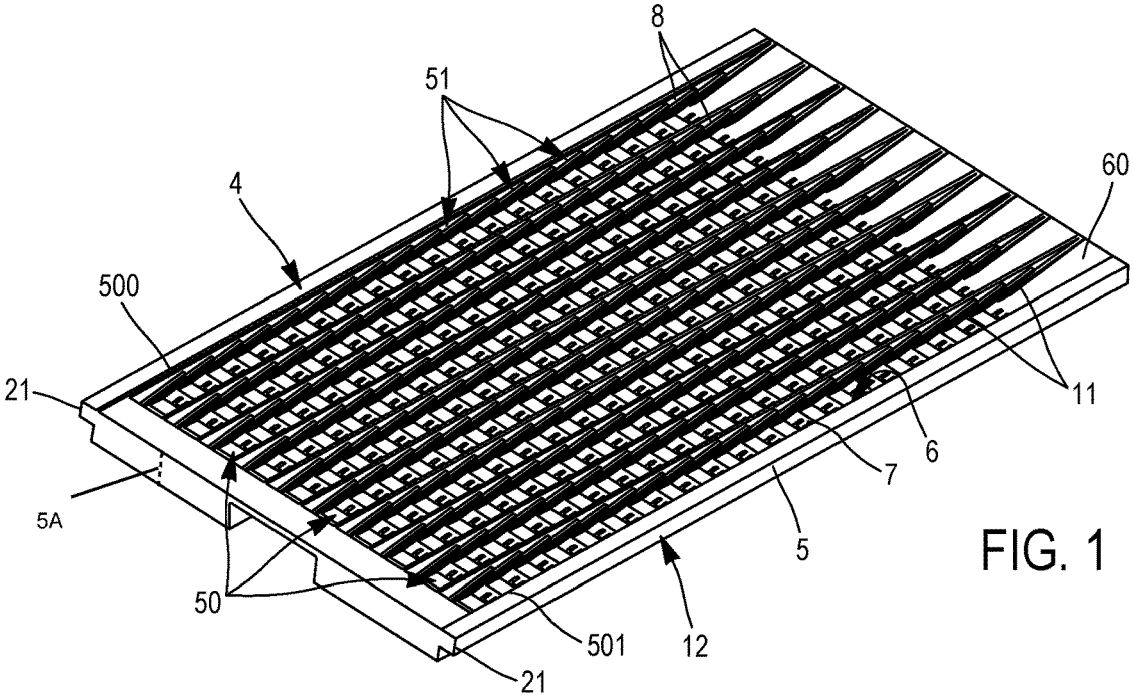
FIG. 1 shows a perspective three-quarters frontal view of a tray according to a preferred embodiment of the invention, wherein it shows the distribution of the cells intended to receive and hold the sample slides.

The invention relates to a slide support 1 in the form of a tray 4. As shown in FIG. 1, such a tray 4 consists of a plate 5 of rectangular parallelepipedal shape with a plate thickness 5A. The plate 5 extends in a plane (plate plane 5B) containing the tray 4, in particular the lower surface of the latter. The plate 5 comprises a plurality of aligned cells 6 forming, in the embodiment shown, ten parallel columns 50 and twenty parallel rows 51. Each cell 6 is intended to receive a slide 1. The position of a slide 1 inserted into a cell 6 may then be referenced two-dimensionally by recording the corresponding column and row.

In order to allow the insertion of the slides 1, the cells 6 are hollowed out within the plate thickness 5A of the plate 5. In addition, each cell 6 is shaped and dimensioned, at least in part, in a complementary manner to the shape and dimensions of a slide 1, with sufficient clearance to facilitate the introduction and extraction of the slide 1 into and out of the cell 6. In sum, each cell 6 has a hollow shape, generally rectangular parallelepiped, i.e. a sort of hollow square.

Furthermore, each cell 6 is shaped to allow the insertion of a slide 1, preferably longitudinally, i.e. according to the length of the slide 1. Each cell 6 is provided with at least one bottom 7 having a bottom length 7A, a bottom width 7B and a bottom plane 7C, opposing side walls 8, and is accessible via an entrance opening 9. In the embodiment shown, each cell 6 is blind with a transverse wall 17 extending between the two opposing side walls 8, and facing the entrance opening 9. The transverse wall 17 forms a stop 17A for a slide 1 inserted into a cell 6. According to the preferred embodiment shown in the figures, the transverse wall 17 forms an obtuse angle β with the bottom 7 of a cell 6. According to another embodiment (not shown), the transverse wall 17 may be arranged orthogonally with respect to the bottom 7. Therefore, when the slide 1 is properly inserted into the cell 6, it extends between the side walls 8 and abuts against the transverse wall 17.

Figure 2:
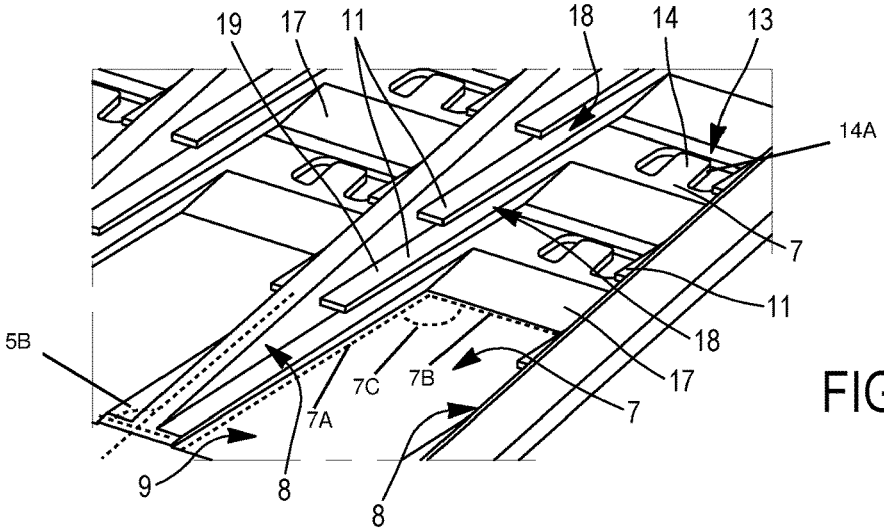
FIG. 2 shows an enlarged perspective view of a part of the tray of FIG. 1.

Furthermore, each cell 6 comprises means for guiding in a slide 1, wherein the means comprise at least the side walls 8. According to the embodiment shown in FIG. 1-3, the guide means further comprise protuberances 11. These protuberances 11 extend from the opening 9 of each cell 6 to its transverse wall 17. They allow each slide 1 to be guided upon introduction into, or extraction out of, a cell 6 by sliding.

It should be noted that the protuberances 11 may extend 1 to 3 mm into a cell 6. Each protuberance 11 may extend continuously or discontinuously along a respective side wall 8. According to the continuous mode shown in the figures, the protuberances 11 of a first cell 6 then form, with the protuberances 11 of an adjacent cell 6, a sliding element 18 for guiding a slide 1, while also ensuring part of its retention within its cell 6. In fact, each protuberance 11 of a cell 6 is spaced with respect to the corresponding protuberance 11 of an adjacent cell 6, namely at a distance d that is almost equivalent to the thickness e of a slide 1. The latter is therefore blocked orthogonally at its edges that are intended to slide between and along two partially superimposed protuberances 11, and may only move by sliding in the direction of insertion and extraction parallel to the protuberances 11.

Figure 3:
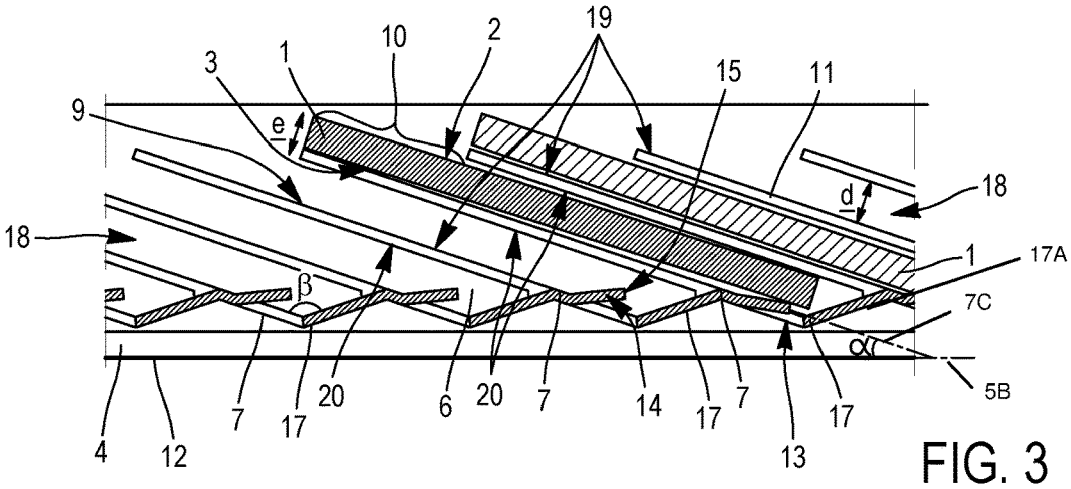
FIG. 3 shows a partial perspective view of the tray of FIG. 1 in a vertical section taken along several adjacent cells, wherein it shows the configuration and the orientation of the elastic member in the form of a tongue within empty cells and within cells containing a slide.

In the alternative embodiment shown in FIG. 3, the guiding means may also consist of a portion of the bottom 7 of a cell 6. In this embodiment, the upper surface 19 of each protuberance 11 protrudes as the extension of the bottom 7 of an adjacent cell 6. Such a structure allows each slide 1 to slide continuously upon insertion, not only between the protuberances 11 of two adjacent cells 6, but also between a protuberance 11 and the bottom 7 of an adjacent cell 6, until it abuts against the transverse wall 17 of a cell 6. In other words, the upper surface 19 of a protuberance 11 of a first cell 6 comes into contact with the bottom 7 of an adjacent cell 6. Thus, as may be seen in FIG. 3, the lower surface 20 of each protuberance 11 is in contact with the upper surface 2 of a slide 1 inserted in a first cell 6, while the upper surface 19 of such a protuberance 11 is then in contact with the lower surface 3 of another slide 1 introduced into the adjacent cell 6. Thus, the protuberances 11 of two consecutive cells 6 together form a sliding element 18 adapted to receive the longitudinal edges (the longest) of a slide 1. Other configurations (not shown) may be considered, such as cells 6 extending transversely and receiving the slides 1 by sliding along their lateral end edges (the shortest).

In addition, in order to allow the insertion and extraction of the slides 1 into and out of the cells 6, the bottoms 7 of the cells 6 and the protuberances 11 forming the sliding elements 18, are inclined relative to the plane containing the plate 5. First of all, such an inclination is provided at a minimum angle α that allows and facilitates the manual or automatic gripping of the end of a slide 1 located at the opening 9 of a cell 6. In addition, this angular inclination makes it possible to allow the partial overlapping of two slides 1 inserted within adjacent cells 6.

Such overlapping takes place over a portion of the length of each slide 1, leaving at least one portion 10 of the upper surface 2 with the identification data uncovered. This partial overlapping arrangement is thus achieved by the inclination of the sliding element 18 in the cells 6, along with the fact that each sliding element 18 has a length less than that of a slide 1, thus creating a protuberance and leaving a portion 10 of the latter extending out of its cell 6.

In addition, as mentioned above, part of an adjacent cell 6 is constituted by its bottom 7 and the surface of the protuberances 11 of a first cell 6. This arrangement makes it possible to ensure the retention of each slide 1 in its cell 6 on both sides of its lower surface 3 and its upper surface 2 over a sufficient distance. For example, this sufficient distance may represent one third to three quarters of each slide 1. In other words, the length of the protuberances 11 is so determined that the stroke of a slide 1 upon its insertion into a cell 6 is limited in order that at least its upper surface portion 2 extends beyond the cell 6. Preferably, the upper surface portion 10 corresponds to at least the area covered by the identification data of each slide 1. This stroke over a given distance is stopped by the transverse wall 17 forming a stop.

Thus, it is in fact the inclination combined with the reduced length of each slot 10 relative to the total length of a slide 1, which makes it possible to partially overlap the slides 1 and produce a protuberance leaving visible the portion 10 of the surface 2 carrying the identification data.

Advantageously, the inclination of the bottom plane 7C of the bottom 7 of the cells 6 (and the protuberances 11) has a minimum angle α of 5° and a maximum angle α of 45°, relative to the plate plane 5B in which the tray 4 extends. Beyond 45° inclination, the tray 4 would have a substantial height and would be more like a drawer.

Preferably, the angle α lies between 8° and 28°. This choice makes it possible to optimize, on the one hand, the number of cells 6 for a given length of tray 4, but also to ensure sufficient inclination, while maintaining a reasonable thickness of the tray 4.

It should be noted that the inclination is determined relative to the plane containing the tray 4, i.e. the plane coinciding with its lower surface, or its upper surface. Therefore, this inclination is independent of the orientation of the tray 4 itself, which may be horizontal, vertical or angled.

Advantageously, the inclined arrangement and partial overlapping of the slides 1, as retained transversely by the slots 10 and the bottom 7 of the cells 6 at their edges and allowing the sliding movement only within the sliding elements 18, increases the retention of the slides 1, even in the event of the tray 4 being turned or tipped over, except in the case of being tipped over in the direction of extraction from the cells 6, and thus considerably limits the risks.

Advantageously, in order to prevent such a movement in the direction of extraction, each cell 6 comprises holding means 13 for insertion of a slide 1.

Such holding means 13 comprise at least one elastic member 14 which abuts against a surface of the slide 1 being inserted into the cell 6. In other words, at least one elastic member 14 is present in each cell 6 and comes into contact with a surface of the slide 1 upon insertion and presses it against a wall or an element of the cell 6, in particular, the guiding means, in particular the protuberances 11.

In addition, the elastic nature of the member 14 allows its deformation, in particular, during the insertion of the slide 1, while its resilience provides sufficient pressure to prevent the slide 1 from moving, while allowing the return of this member 14 to the unconstrained position once the slide 1 is extracted from its cell 6.

Thus, a slide 1 is forcibly introduced into a cell 6 and deforms and pushes the member 14 until it abuts against the transverse wall 17 of the cell 6. The slide 1 is blocked and is no longer able to move freely in the direction of extraction.

According to the preferred embodiment, each member 14 may be in the form of at least one tongue 14 protruding from the bottom 7 of the cell 6. In other words, each tongue 14 extends towards the inside of a cell 6. In the embodiment shown in the figures, each member 14 is in the form of a single tongue 14 per cell 6.

Alternatively, one end of the tongue 14 may be integral with the bottom 7 while an opposite end 15 may remain free. This tongue 14 may therefore be in the form of an extension of the bottom 7 and the material constituting it, as a result of a cutout formed in the bottom 7 and surrounding each tongue 14.

The tongue 14 may extend relative to the bottom 7 so that its free end is oriented towards the transverse wall 17 of the cell 6 in question.

Finally, as mentioned above, the tray 4 may consist at least partly of plastic material conferring elastic characteristics to the holding means of the slides 1, in particular to the tongues 14.

Thus, the holding means in the form of an elastic member 14, preferably a protruding tongue 14, bear against the lower surface 3 of the slide 1 when it is inserted in its cell 6, thus ensuring its perfect retention, without the risk of it coming out naturally as its extraction requires an intended manual or automatic action.

In addition, the inclination of this tongue 14 relative to the bottom 7, its dimensions and the elastic characteristics of its material, provide sufficient holding force while avoiding the risk of damaging the slide 1 thus held and blocked by these holding means within each cell 6 of such a tray 4.

It should also be noted that, according to an additional characteristic of the invention, the two opposite longitudinal edges 500, 501 of the tray 4 according to the invention shown in the figures, are each extended by a rail 21 that is designed to interact with a sliding element 22 of complementary shape within a cabinet 23 shaped to house at least one such tray 4.

Thus, the invention also relates to such a cabinet 23 shaped to house at least one tray 4 and comprising a bottom 24 surmounted by a peripheral wall 25 having an entrance opening 26 and an upper wall 27 opposite the bottom 24. In the embodiment shown, the cabinet 23 according to the invention comprises means forming a sliding element 22 that extends appropriately on the inner surfaces of the bottom 24 and the upper wall 27. Such a structure allows the trays 4 to be stored vertically in the cabinet 23, and thus avoid possible deformation phenomena observed when stored horizontally. It has also been found that vertical storage trays 4 optimize the capacity of the cabinet 23 to house more trays 4 than in a horizontal storage orientation. Thus, more slides 1 may be stored within the same volume.

The invention also relates to a device 30 for identifying slides 1 contained within a tray 4 according to the invention, as previously described.

Such a device 30 consists of an envelope 70 enclosing means designed to detect the presence of a slide 1 within each cell 6 and to identify a slide 1 when present, i.e. detected. This identification takes place via the reading of the identification data affixed to the portion 10 of the upper surface 2 of each slide 1 which remains visible due to the partial overlap conferred by the specific configuration of the cells 6 of the tray 4 according to the invention.

In addition, the envelope 70 has a traversing opening 71 that is dimensionally complementary to the dimensions of the tray 4, and through which it may be introduced and extracted into and out of a cavity 72 formed in the device 30.

Figure 4:
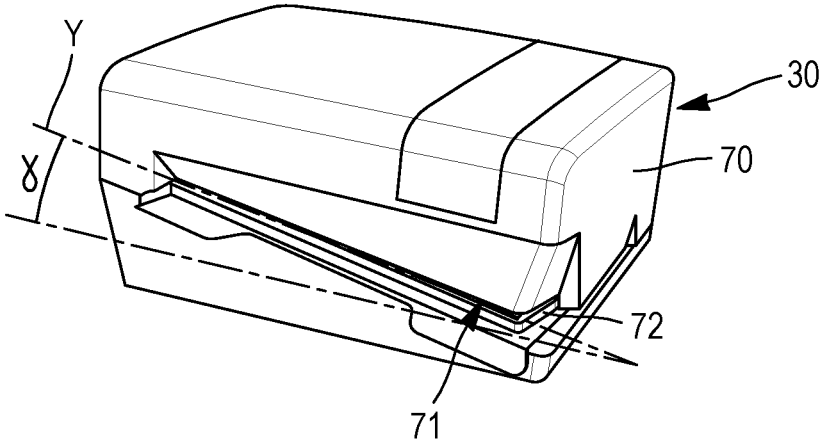
FIG. 4 shows schematically a perspective view of an identification device according to a specific embodiment, wherein the device is specifically designed to receive a tray according to the invention.
Figure 5:
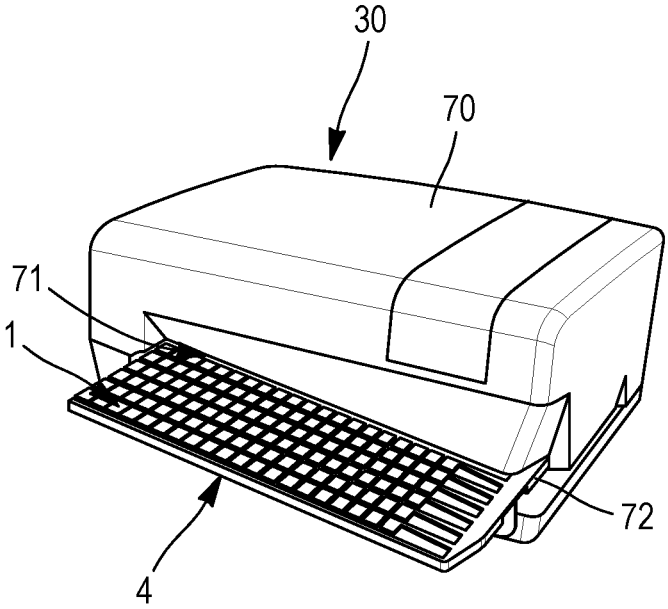
FIG. 5 shows schematically a perspective view of the device of FIG. 4, wherein a tray according to the invention is introduced for the purpose of identifying the slides held by the tray.
Figure 6:
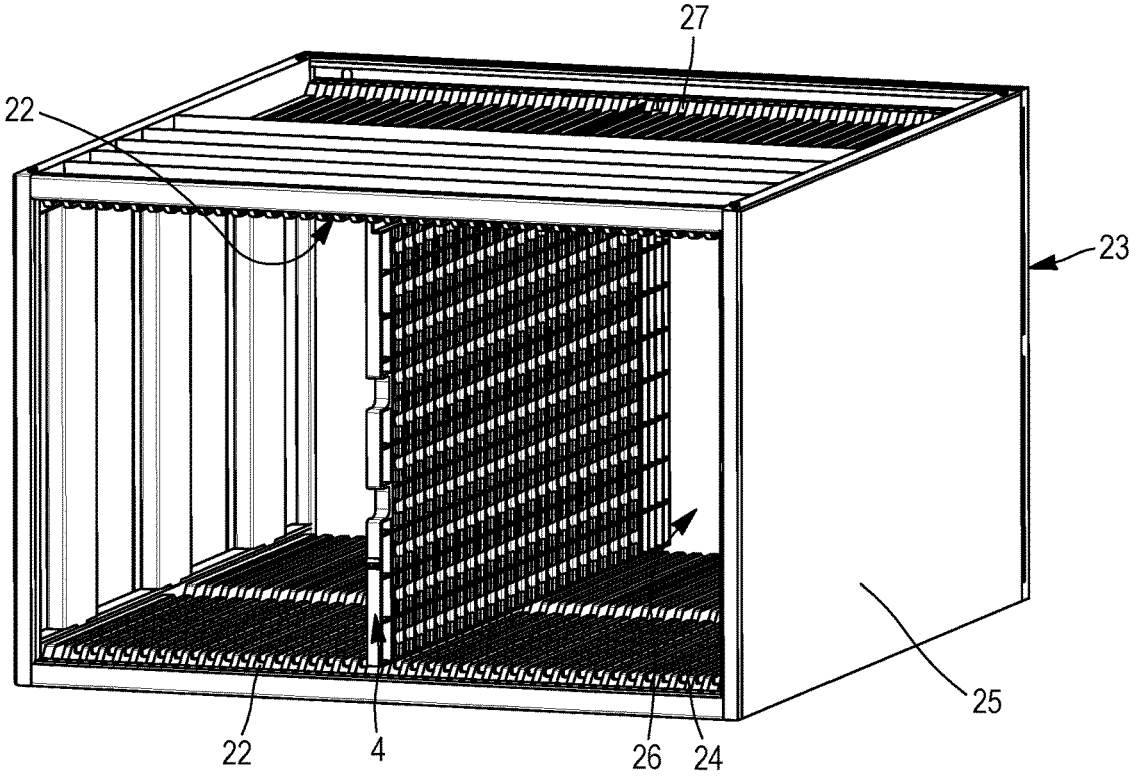
FIG. 6 shows a partial perspective view of a cabinet according to the invention containing a tray according to the invention.
Figure 7:
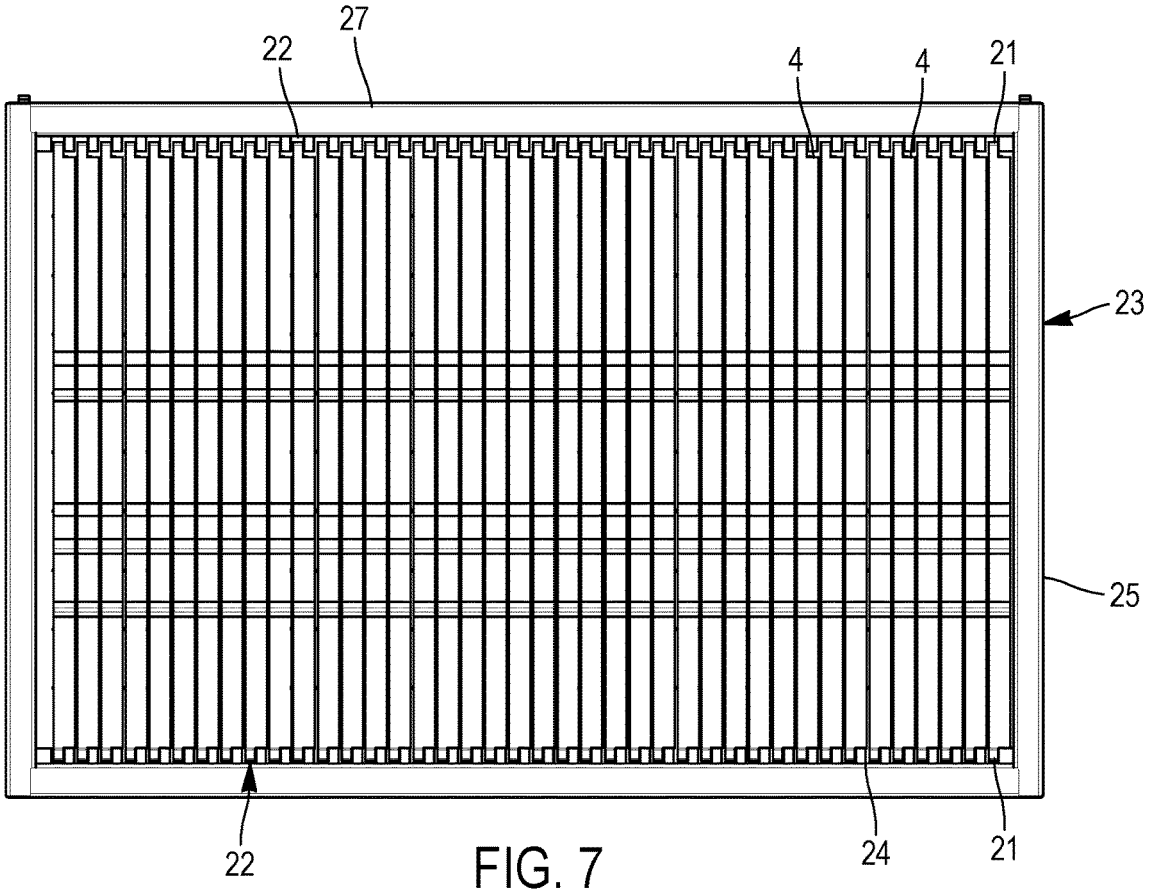
FIG. 7 shows a front elevation view of the cabinet of FIG. 6.

Advantageously, as may be seen in the preferred embodiment of the device 30 shown in FIGS. 4 and 5, the opening 71 and the cavity 72 extend longitudinally, i.e. along the longest edge of the device 30. In addition, the cavity 72 is inclined relative to a horizontal plane containing the device 1. In particular, the longitudinal axis Y of the cavity 72 extends obliquely and is inclined at an angle γ relative to the plane formed by the lower surface of the device 30, which corresponds in a non-limiting manner to the horizontal plane on which it is intended to be placed.

Like the tray 4, this inclination makes it possible to optimize the dimensions of the device 30 by limiting its bulk, in particular its length. On the other hand, the device 30 then has a greater height. This optimization makes it easier to position the device 30 on cabinets of limited width.

In a related context, the inclination of the tray 4 within the device 30 improves detection and reading by the means provided for this purpose.

According to a preferred embodiment, the angle of inclination γ of the longitudinal axis Y of the cavity 72 is at least 5° and at most 90°. Preferably, this angle of inclination γ lies between 5° and 45°, for example equal to 8°.

It should be noted that the choice of angles within the tray 4, as well as the device 30, is not arbitrary, but is chosen in order to optimize their respective dimensions.

We claim:

1. A tray for storage of sampling slides, comprising:

a plate having a plate thickness and a plate plane and comprising a plurality of aligned cells within said plate thickness so as to at least partially fit sample slides, wherein each cell comprises:

a bottom, having a bottom length, a bottom width, and a bottom plane, two side walls, each side wall being opposite each other across said bottom width and along said bottom length so as to form an entrance opening, a transverse wall extending between said two side walls opposite said entrance opening, at least two protuberances, each protuberance projecting laterally from and along a respective side wall and extending from said entrance opening to said transverse wall, wherein each protuberance is parallel to said bottom plane of said bottom so as to form a sliding element for a sample slide to be stored in the cell, and wherein said bottom plane is inclined at an angle relative to said plate plane so as to form a stop with said transverse wall and so as to extend the sample slide at said stop past respective protuberances, wherein each cell further comprises an elastic member on said bottom, said elastic member being movable between a released position and a constrained position.

2. The tray, according to claim 1, wherein said angle of said bottom plane relative to said plate plane is between 5° and 45°.

3. The tray, according to claim 1, wherein each elastic member is comprised of a tongue protruding from said bottom.

4. The tray, according to claim 3, wherein said tongue has an end secured to said bottom and an opposite end separate from said bottom.

5. The tray, according to claim 4, wherein said tongue extends from said end secured to said bottom toward said transverse wall, said opposite end being between said end secured to said bottom and said transverse wall.

6. The tray, according to claim 1, wherein elastic member is comprised of plastic material.

7. The tray, according to claim 1, further comprising:

two edges, each edge being opposite each other, wherein each edge comprises a means for sliding said tray so at to house said tray in a cabinet.

* * * * *